US007347681B2

(12) United States Patent
Ugai et al.

(10) Patent No.: US 7,347,681 B2
(45) Date of Patent: Mar. 25, 2008

(54) PERMANENT MAGNET MOLDING APPARATUS

(75) Inventors: Yoshikazu Ugai, Tokyo (JP); Taizo Iwami, Tokyo (JP); Yuji Nakahara, Tokyo (JP); Yasuo Ozeki, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 246 days.

(21) Appl. No.: 10/506,531

(22) PCT Filed: Apr. 18, 2003

(86) PCT No.: PCT/JP03/04951

§ 371 (c)(1),
(2), (4) Date: Sep. 3, 2004

(87) PCT Pub. No.: WO03/092020

PCT Pub. Date: Nov. 6, 2003

(65) Prior Publication Data

US 2005/0208164 A1 Sep. 22, 2005

(30) Foreign Application Priority Data

Apr. 24, 2002 (JP) ..... 2002-121528

(51) Int. Cl.
*B22F 3/00* (2006.01)

(52) U.S. Cl. ..... 425/78; 425/354; 425/3

(58) Field of Classification Search ..... 425/3, 425/78, 354

See application file for complete search history.

(56) References Cited

U.S. PATENT DOCUMENTS 3,555,621 A * 1/1971 Ei Hara ..... 425/3
3,663,147 A * 5/1972 Maekawa et al. ..... 425/345
5,762,967 A * 6/1998 Sagawa et al. ..... 425/3

(Continued)

FOREIGN PATENT DOCUMENTS

JP 7-44121 12/1992

(Continued)

OTHER PUBLICATIONS

Chinese Office Action dated May 16, 2006.

(Continued)

*Primary Examiner*—Yogendra N. Gupta
*Assistant Examiner*—Maria Veronica Ewald
(74) *Attorney, Agent, or Firm*—Buchanan Ingersoll & Rooney PC

(57) ABSTRACT

This invention relates to a permanent magnet molding apparatus and has as an object an improvement in productivity and reliability thereof. This invention includes a transferable metal die unit (7) including a die having a cavity of a desired cross-sectional shape in which magnet molding material powder is filled, the cavity extending in groovelike form in a specific direction on a surface of the die, a lid member placed to cover the cavity, and a pair of punches having the same cross-sectional shape as the cavity, the punches being capable of fitting in the cavity from both ends thereof and made slidable in directions in which the punches go into contact with and become separated from the magnet molding material powder, pressurizing means (17, 18) for holding the metal die unit (7) which has been transferred with the magnet molding material powder filled in the cavity and for pressurizing the magnet molding material powder by driving the two punches such that the punches slide in their approaching directions, and magnetic field generating means (21, 22) for magnetizing the pressurized magnet molding material powder while applying a magnetic field thereto in a direction perpendicular to a direction of pressurization.

14 Claims, 16 Drawing Sheets

U.S. PATENT DOCUMENTS

| | | | | |
|---|---|---|---|---|
| 6,355,210 | B1 | 3/2002 | Hirabayashi | |
| 6,602,352 | B2 * | 8/2003 | Okumura et al. | 148/103 |

FOREIGN PATENT DOCUMENTS

| | | | |
|---|---|---|---|
| JP | 6-96973 | A | 4/1994 |
| JP | 7-240332 | | 9/1995 |
| JP | 10-264119 | A | 10/1998 |
| JP | 11-195548 | | 7/1999 |
| JP | 2000-223338 | A | 8/2000 |
| JP | 2002-86300 | A | 3/2002 |
| JP | 2002-105505 | A | 4/2002 |

OTHER PUBLICATIONS

Supplementary European Search Report dated Jun. 6, 2007.

* cited by examiner

PERMANENT MAGNET MOLDING APPARATUS

TECHNICAL FIELD

The present invention relates to a permanent magnet molding apparatus for sequentially transferring a plurality of metal die units filled with powder of magnet molding material and forming molded permanent magnet products by pressurizing the powder of the magnet molding material in the metal die units and magnetizing the powder while applying a magnetic field in a direction perpendicular to a pressurizing direction.

BACKGROUND ART

Although not illustrated, a conventional permanent magnet molding apparatus is generally so constructed as to fill powder of magnet molding material into a cavity of a metal die unit including a die, in which the cavity is formed, and a punch located against the die and to pressurize the powder of the magnet molding material with the punch while magnetizing the powder by applying a magnetic field to the powder by means of a pair of coils situated in a surrounding area of the metal die unit, as disclosed in Japanese Laid-open Patent Publication No. H7-115030,for example.

In the conventional permanent magnet molding apparatus constructed as described above, a molded permanent magnet product is taken out of the metal die unit when finished and the powder of the magnet molding material is filled in the emptied cavity. Since permanent magnet products are produced one after another by repeating such product removal and powder filling cycles in successive turns, it is necessary to interrupt magnetizing and pressurizing operations while the powder of the magnet molding material is being filled, causing a deterioration in productivity. In addition, since the powder of the magnet molding material is filled in an area where the magnetic field is applied, there have been a problem that there occur variations in the amount of the filled powder of the magnet molding material, resulting in a reduction in reliability.

This invention has been made to solve the aforementioned problem and, accordingly, it is an object of the invention to provide a permanent magnet molding apparatus capable of achieving an improvement in productivity and reliability.

DISCLOSURE OF THE INVENTION

A first permanent magnet molding apparatus of this invention includes:

a transferable metal die unit including a die having a cavity of a desired cross-sectional shape in which magnet molding material powder is filled, the cavity extending in groovelike form in a specific direction on a surface of the die, a lid member placed against a facing surface of the aforementioned die as if covering the aforementioned cavity, and a pair of punches having the same cross-sectional shape as the aforementioned cavity, the aforementioned punches being positioned to fit in the aforementioned cavity such that the punches close the aforementioned cavity at both ends thereof, and the punches being made slidable in directions in which the punches go into contact with and become separated from the magnet molding material powder;

pressurizing means for holding the metal die unit which has been transferred with the aforementioned magnet molding material powder filled in the aforementioned cavity and for pressurizing the aforementioned magnet molding material powder by driving the aforementioned two punches such that the aforementioned two punches slide in their approaching directions; and magnetic field generating means for magnetizing the magnet molding material powder pressurized in the aforementioned cavity while applying a magnetic field thereto in a direction perpendicular to a direction of pressurization.

In this construction, it is possible to provide a permanent magnet molding apparatus which makes it possible to achieve an improvement in productivity and reliability.

A second permanent magnet molding apparatus of this invention differs from the aforementioned first permanent magnet molding apparatus in that the aforementioned magnetic field generating means includes a pair of, yokes located on an upper surface of the lid member and on a bottom surface of the die of the aforementioned metal die unit and a coil wound around at least one of the aforementioned yokes, wherein the aforementioned yokes are movable in directions along the aforementioned facing surface of the lid member and the die of the aforementioned metal die unit.

In this construction, it is possible to hold the yokes in close contact with the metal die unit so that a large and uniform magnetizing field is produced.

A third permanent magnet molding apparatus of this invention differs from the aforementioned second permanent magnet molding apparatus in that the aforementioned pair of yokes are attracted by each other and sandwich the aforementioned lid member and die to press against the aforementioned facing surface when the aforementioned coil is actuated.

In this construction, it is made unnecessary to provide complicated structure or large-sized equipment for pressing the facing surface.

A fourth permanent magnet molding apparatus of this invention differs from the aforementioned first permanent magnet molding apparatus in that the aforementioned metal die unit has a gap of 0.01 to 0.1 mm in part of the aforementioned facing surface.

In this construction, gas in the cavity can be smoothly discharged, so that cracks and external defects on a molded product are reduced.

A fifth permanent magnet molding apparatus of this invention differs from the aforementioned first permanent magnet molding apparatus in that the aforementioned metal die unit has a base frame on which the aforementioned die is located and the aforementioned pair of punches has pushing parts at one end which are pressed by the aforementioned pressurizing means and caused to slide on the aforementioned base frame while being guided along the extending direction of the aforementioned cavity.

In this construction, it is possible to provide a permanent magnet molding apparatus which makes it possible to achieve an improvement in productivity.

A sixth permanent magnet molding apparatus of this invention differs from the aforementioned fifth permanent magnet molding apparatus in that the aforementioned pressurizing means is a pair of cylinders situated along the extending direction of the aforementioned cavity, wherein pistons of the aforementioned cylinders extend face to face with end surfaces of the pushing parts of the aforementioned punches to push the aforementioned pushing parts, causing the aforementioned punches to slide in their mutually approaching directions.

In this construction, it is possible to provide a permanent magnet molding apparatus which makes it possible to achieve a cost reduction, not to mention an improvement in productivity.

A seventh permanent magnet molding apparatus of this invention differs from the aforementioned fifth permanent magnet molding apparatus in that the seventh permanent magnet molding apparatus further includes a grasping member which engages with the aforementioned base frame, wherein the aforementioned grasping member fits slidably in the extending direction of the aforementioned cavity and the aforementioned lid member is forced against the aforementioned die and held in position via a locking mechanism between the aforementioned base frame and the aforementioned grasping member.

According to this construction, it is possible to provide a permanent magnet molding apparatus which makes it possible to achieve a further improvement in productivity.

An eighth permanent magnet molding apparatus of this invention differs from the aforementioned seventh permanent magnet molding apparatus in that the aforementioned grasping member is divided into two portions in its sliding direction.

According to this construction, it is possible to provide a permanent magnet molding apparatus which makes it possible to achieve a further improvement in productivity.

A ninth permanent magnet molding apparatus of this invention differs from the aforementioned first permanent magnet molding apparatus in that the aforementioned metal die unit has a base frame on which the aforementioned die is located and the aforementioned pair of punches has pushing parts at one end which are pushed by the aforementioned pressurizing means and caused to slide on the aforementioned base frame while being guided along the extending direction of the aforementioned cavity, the aforementioned pushing parts having rotatably mounted rollers.

According to this construction, it is possible to provide a permanent magnet molding apparatus which makes it possible to achieve an improvement in productivity.

A tenth permanent magnet molding apparatus of this invention differs from the aforementioned ninth permanent magnet molding apparatus in that the aforementioned. pressurizing means has first guiding surfaces for guiding the aforementioned rollers and second guiding surfaces formed immediately adjacent to the respective first guiding surfaces, wherein the distance between the aforementioned second guiding surfaces is smaller than the distance between the aforementioned first guiding surfaces and the aforementioned second guiding surfaces press against the aforementioned rollers, causing the aforementioned punches to slide in their mutually approaching directions.

According to this construction, it is possible to provide a permanent magnet molding apparatus which makes it possible to achieve a further cost reduction, not to mention an improvement in productivity.

An eleventh permanent magnet molding apparatus of this invention differs from the aforementioned ninth permanent magnet molding apparatus in that the eleventh permanent magnet molding apparatus further includes a grasping member which engages with the aforementioned base frame, wherein the aforementioned grasping member fits slidably in the extending direction of the aforementioned cavity and the aforementioned lid member is forced against the aforementioned die and held in position via a locking mechanism between the aforementioned base frame and the aforementioned grasping member.

According to this construction, it is possible to provide a permanent magnet molding apparatus which makes it possible to achieve a further improvement in productivity.

A twelfth permanent magnet molding apparatus of this invention differs from the aforementioned eleventh permanent magnet molding apparatus in that the aforementioned grasping member is divided into two portions in its sliding direction.

According to this construction, it is possible to provide a permanent magnet molding apparatus which makes it possible to achieve a further improvement in productivity.

BEST MODES FOR CARRYING OUT THE INVENTION

Individual embodiments of the present invention are described in the following with reference to the drawings.

First Embodiment

Figure 1:
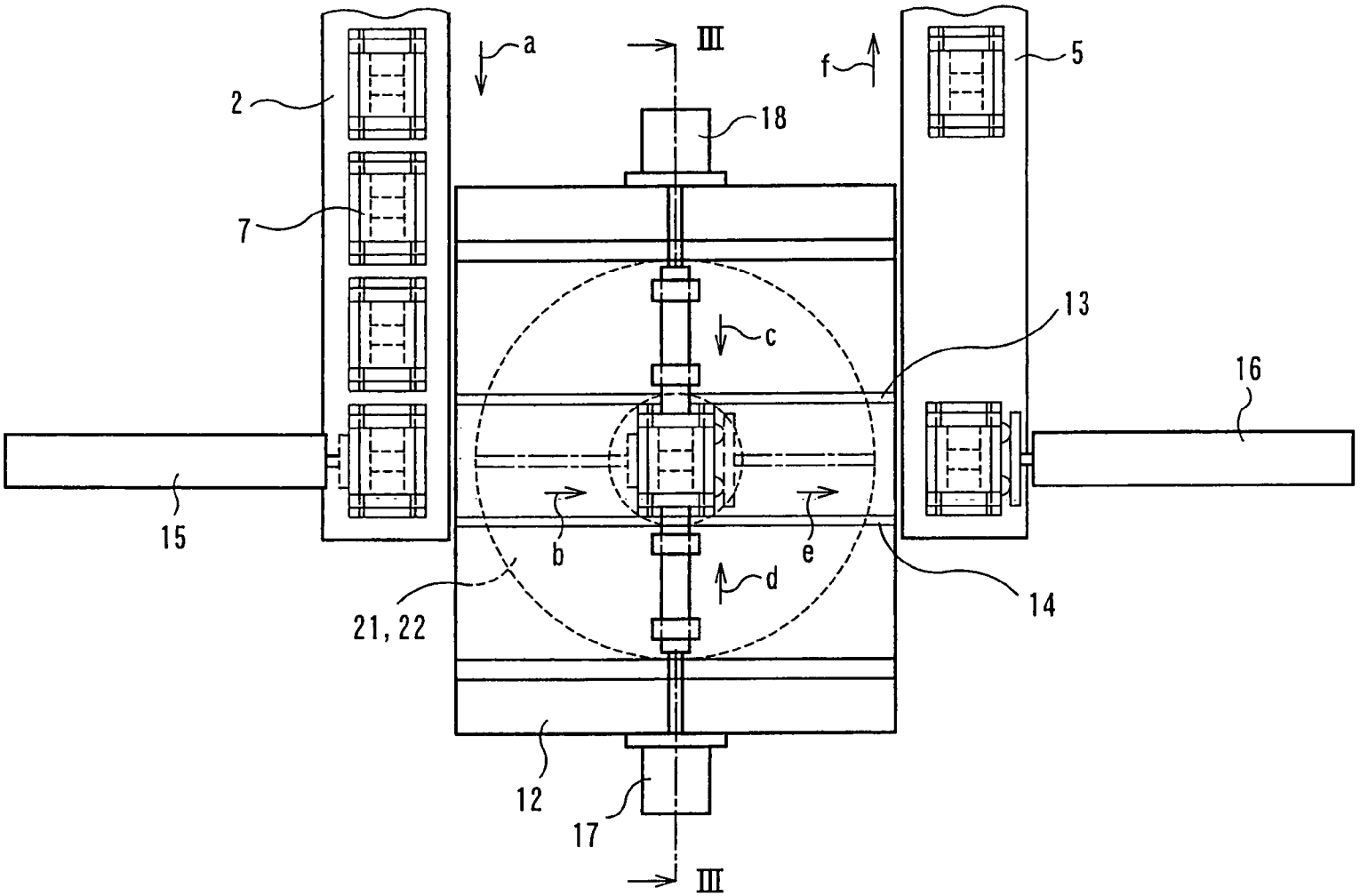
FIG. 1 is a plan view showing the construction of a permanent magnet molding apparatus according to a first embodiment of this invention.
Figure 2:
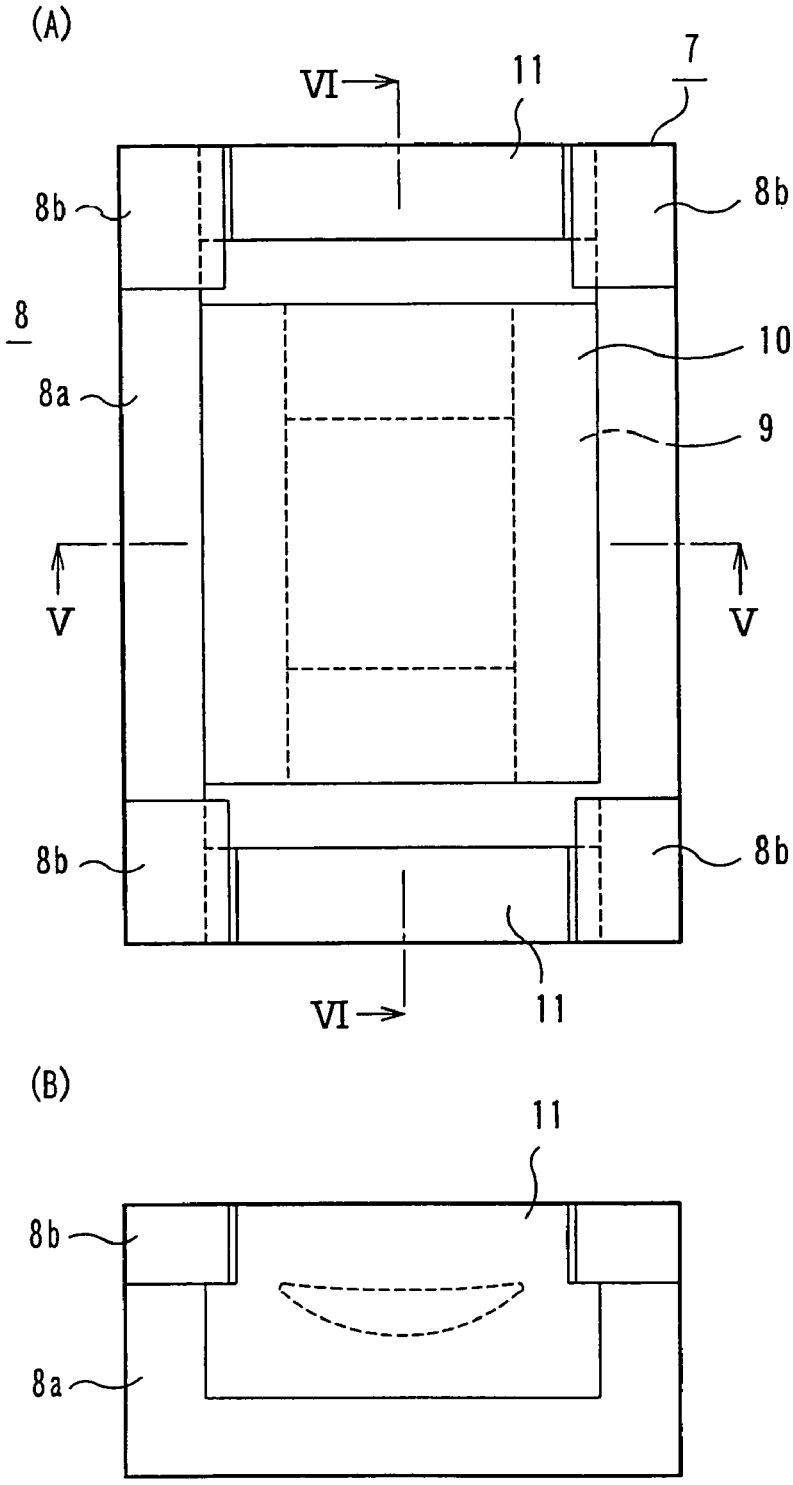
FIG. 2 shows the construction of a metal die unit of FIG. 1, in which (A) is a plan view and (B) is a front view.
Figure 3:
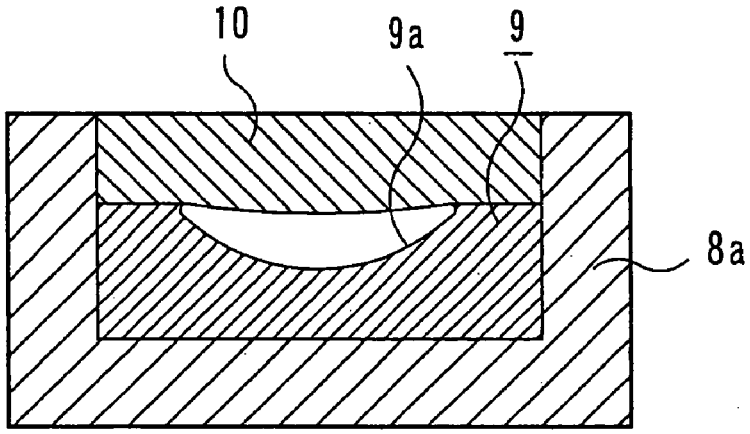
FIG. 3 is a sectional diagram showing a cross section taken along lines V-V of FIG. 2.
Figure 4:
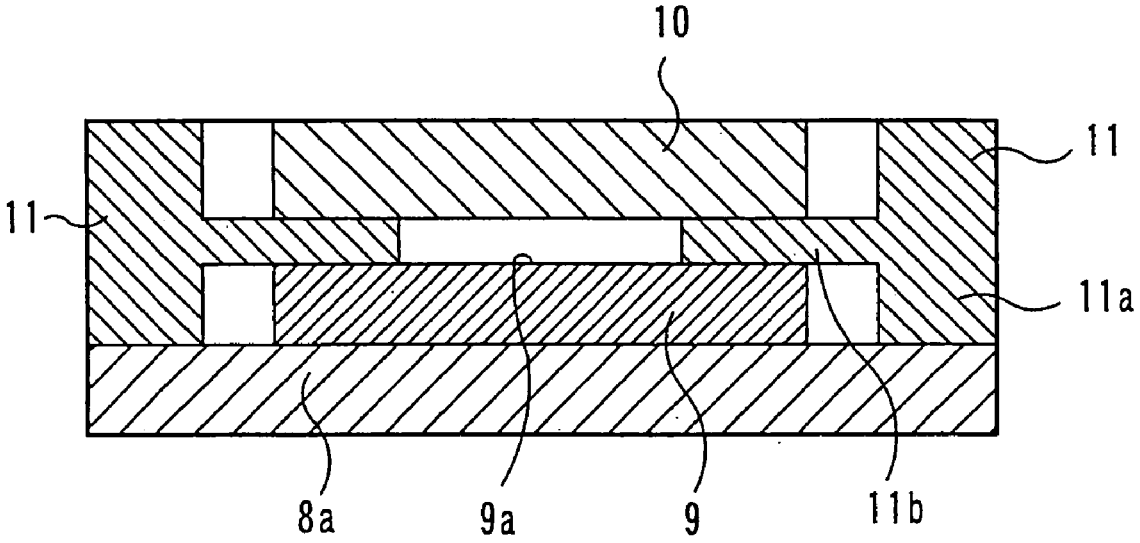
FIG. 4 is a sectional diagram showing a cross section taken along lines VI-VI of FIG. 2.
Figure 5:
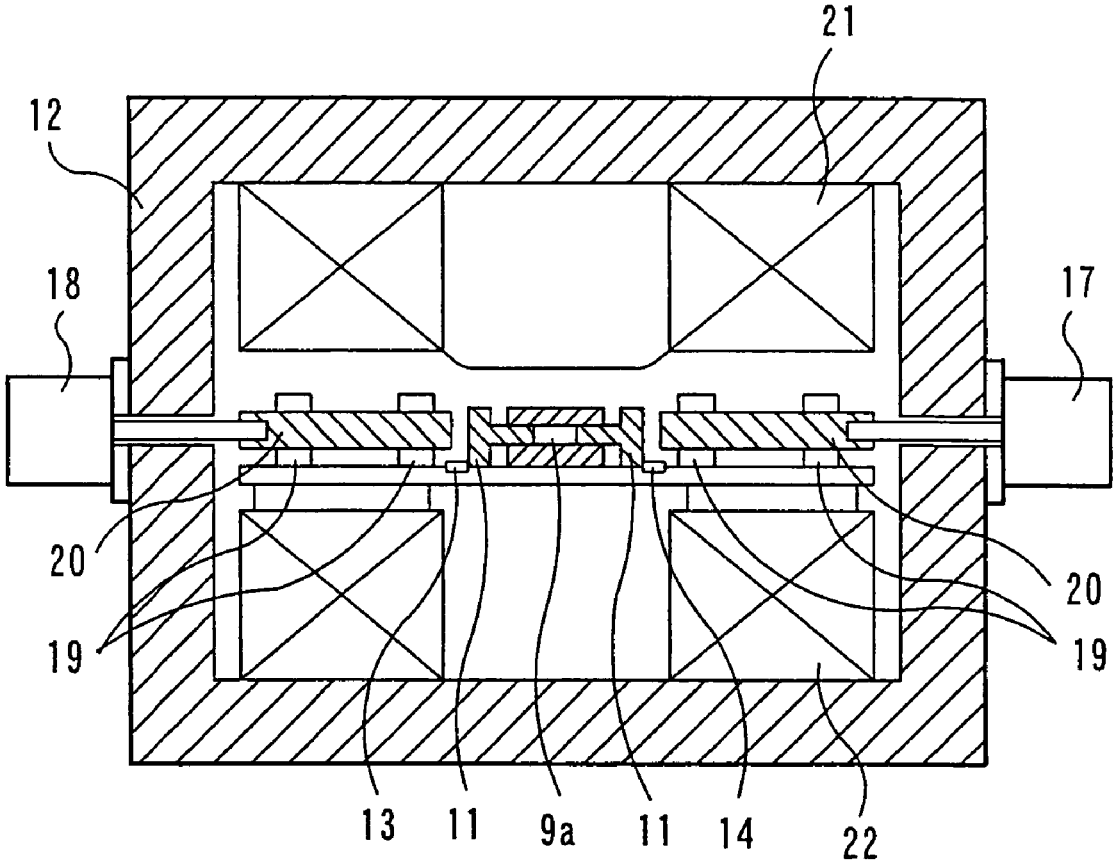
FIG. 5 is a-sectional diagram showing a cross section taken along lines III-III of FIG. 1.
Figure 6:
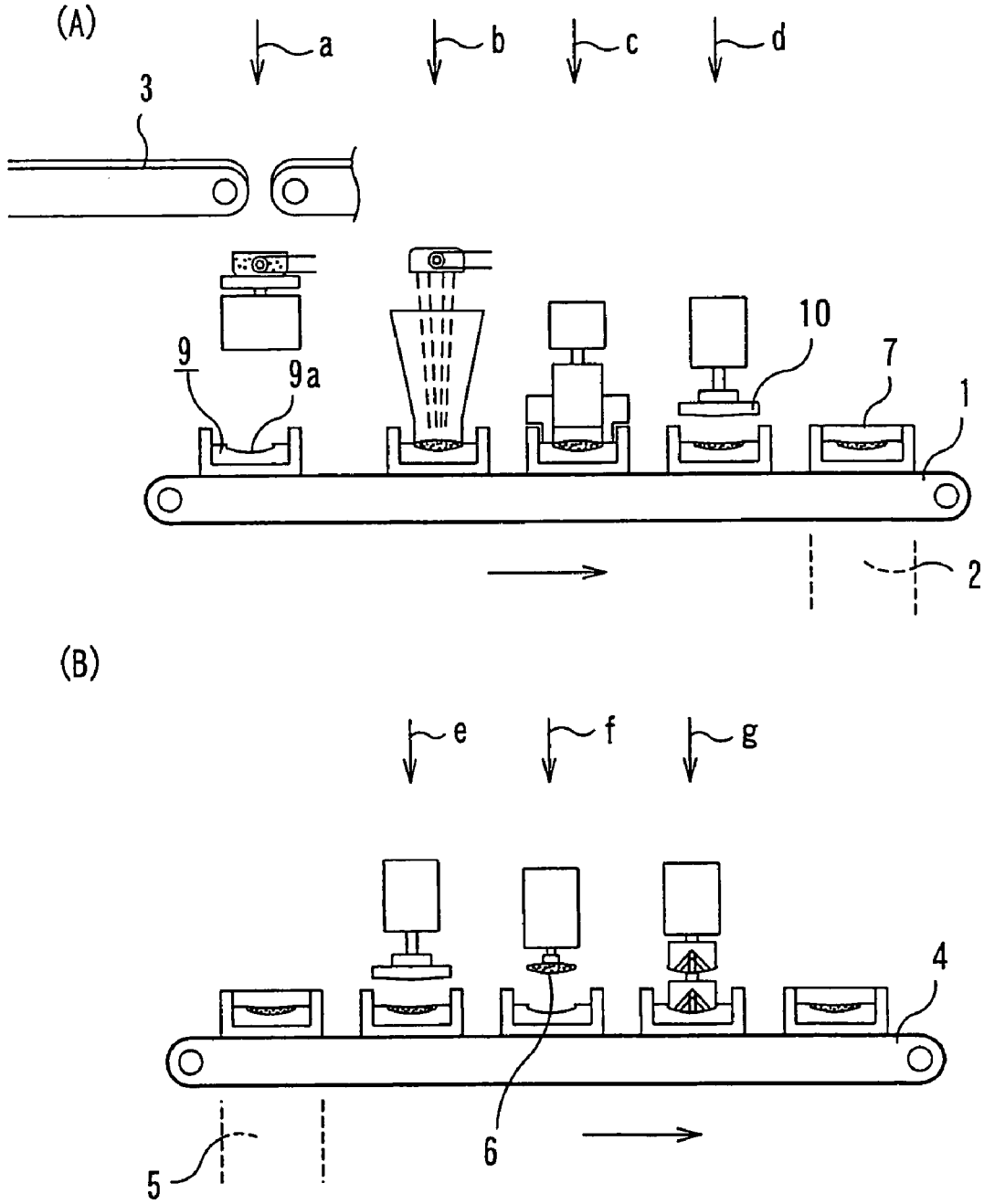
FIG. 6 is a diagram showing earlier and later stages of a process of manufacturing the permanent magnet molding apparatus of FIG. 1.

FIG. 1 is a plan view showing the construction of a permanent magnet molding apparatus according to a first embodiment of this invention, FIG. 2 shows the construction of a metal die unit of FIG. 1, in which (A) is a plan view and (B) is a front view, FIG. 3 is a sectional diagram showing a cross section taken along lines V-V of FIG. 2, FIG. 4 is a sectional diagram showing a cross section taken along lines VI-VI of FIG. 2, FIG. 5 is a sectional diagram showing a cross section taken along lines III-III of FIG. 1, and FIG. 6 is a diagram showing earlier and later stages of a process of manufacturing the permanent magnet molding apparatus of FIG. 1.

The permanent magnet molding apparatus of this embodiment includes a second belt conveyor 2 for transferring metal die units 7 filled with powder of magnet molding material, a fourth belt conveyor 5 for transferring the metal die units 7 in which the filled powder of the magnet molding material has already been shaped, a mounting base 12 placed between the second belt conveyor 2 and the fourth belt conveyor 5, a first cylinder 15, a second cylinder 16, coils 21, 22 mounted on the mounting base 12, pressurizing cylinders 17, 18 and guide plates 13, 14 for guiding the metal die units 7 as shown in FIG. 1.

The first cylinder 15 is provided for moving the metal die unit 7 filled with the powder of the magnet molding material from the second belt conveyor 2 to a position where the pressurizing cylinders 17, 18 pressurize the powder, whereas the second cylinder 16 is provided for moving the metal die unit 7 in which the powder of the magnet molding material has been shaped and magnetized. Each of the metal die units 7 moves, guided by the guide plates 13, 14.

As shown in FIGS. 2, 3 and 4, the metal die unit 7 includes a base frame 8 formed of a first member 8*a* having a U-shaped cross section and second members 8*b* each having a rectangular parallelepiped shape affixed to four corners of the first member 8*a*, a die 9 situated at a central part of the base frame 8, the die 9 having a cavity 9*a* of a groovelike shape formed in a surface of the die 9 up to end surfaces thereof along a specific direction and the cavity 9*a* having the same cross-sectional shape as a molded permanent magnet product 6, a lid member 10 positioned on the die 9 to cover the cavity 9*a*, and a pair of punches 11 each having a pushing part 11*a* at one end and a shaping part 11*b* having the same cross-sectional shape as the cavity 9*a* at the other end. Sliding on the base frame 8 and between both members 8*a*, 8*b* of the base frame 8, the pushing parts 11*a* are guided along the extending direction of the cavity 9*a*. The shaping parts 11*b* fit in the cavity 9*a* and slide in such a way that the shaping parts 11*b* close the cavity 9*a* at both ends thereof.

The mounting base 12 is formed into a rectangular cross-sectional shape as shown in FIG. 5. The pressurizing cylinders 17, 18 and the pair of coils 21, 22 serving as magnetic field generating means are fixed to the mounting base 12. Serving as pressurizing means, the pressurizing cylinders 17, 18 are arranged along the extending direction of the cavity 9*a* in the metal die unit 7 which has been brought to a specific position by the first cylinder 15. When the pressurizing cylinders 17, 18 operate, their pistons thrust pushrods 20. The pushrods 20 slide along guide members 19 and thrust the pushing parts 11*a* of both punches 11, causing the two punches 11 to slide in directions approaching to each other. The coils 21, 22 are magnetic field generating means which apply a magnetic field to the magnet molding material powder 3 in the die 9 pressurized via the two punches 11 in a direction perpendicular to a pressurizing direction to magnetize the magnet molding material powder 3 in the direction perpendicular to the pressurizing direction.

Operation of the permanent magnet molding apparatus constructed as described above is now explained below referring to the drawings.

First in the earlier manufacturing stage, a specific amount of the magnet molding material powder 3 suited to the size of the cavity 9*a* in the die 9 is extracted at a position shown by an arrow "a" onto a first belt-conveyor 1 as shown in FIG. 6(A). Next, after the magnet molding material powder 3 is charged into the cavity 9*a* at a position shown by an arrow "b," the magnet molding material powder 3 is brought into a thoroughly uniform state at a position shown by an arrow "c." Next, at a position shown by an arrow "d," the cavity 9*a* is closed by covering the top of the die 9 with the lid member 10. Then, the metal die unit 7 of which cavity 9*a* has been filled with the magnet molding material powder 3 is transferred from the first belt conveyor 1 to the second belt conveyor 2.

Subsequently, the metal die unit 7 transferred onto the second belt conveyor 2 moves on the second belt conveyor 2 in the extending direction of the cavity 9*a* along an arrow "a" shown in FIG. 1. When the metal die unit 7 reaches a position corresponding to the first cylinder 15, the metal die unit 7 stops as it is forced against an unillustrated pin or block-shaped positioning jig. As the first cylinder 15 begins to operate, its piston extends and pushes out the halted metal die unit 7 in a direction shown by an arrow "b" intersecting the extending direction of the cavity 9*a* along the two guide plates 13, 14, causing the metal die unit 7 to move up to a line interconnecting the two pressurizing cylinders 17, 18.

Next, as the two pressurizing-cylinders 17, 18 begin to operate, their pistons extend and push the pushing parts 11*a* of the two punches 11 constituting part of the metal die unit 7 from both sides. Consequently, the shaping parts 11*b* are caused to move in the cavity 9*a* in directions of arrows "c" and "d" pointing to each other up to a point where end surfaces of the shaping parts 11*b* are positioned face to face at a specific distance from each other. At this time, the magnet molding material powder 3 in the cavity 9*a* is in a state of being pressed at a specific force. Then, the two coils 21, 22 are activated in this state, so that the magnetic field is applied to the magnet molding material powder 3 in the direction perpendicular to the pressurizing direction and the magnet molding material powder 3 is magnetized.

When magnetization of the magnet molding material powder 3 is finished, the two coils 21, 22 stops to operate. Subsequently, after performing a demagnetizing process by applying a reverse magnetic field, the pistons of the two pressurizing cylinders 17, 18 contract and return to their original positions, becoming separated from the metal die unit 7. Then, the second cylinder 16 begins to operate and its piston extends and reaches the location of the metal die unit 7. Consequently, although not discussed in detail here, after a sucking pad provided at a far end of the piston, for example, has sucked a side surface of the base frame 8 of the metal die unit 7, the piston contracts and returns to its original state as shown by an arrow "e" and sucking condition is released, whereby the metal die unit 7 is transferred onto the fourth belt conveyor 5.

The metal die unit 7 transferred onto the fourth belt conveyor 5 moves in the direction of an arrow "f" on the fourth belt conveyor 5 opposite to the moving direction of the second belt conveyor 2 as shown in FIG. 1.

The metal die unit 7 which has moved in the direction of the arrow "f" on the fourth belt conveyor 5 is transferred onto a third belt conveyor 4 shown in FIG. 6(B) and the later manufacturing stage is carried out. Specifically, after the lid member 10 of the metal die unit 7 is removed, at a position of an arrow "e," the molded permanent magnet product 6 is removed from the cavity 9*a* at a position of an arrow "f" as shown in FIG. 6(B). Then, after the metal die unit 7 including the interior of the cavity 9*a* is cleaned at a position of an arrow "g," each successive metal die unit 7 is returned back to the first belt conveyor 1 shown in FIG. 6(A) for recirculation. On the other hand, although not illustrated, the molded permanent magnet product 6 taken out of the cavity 9*a* is subjected to a post processing step, such as sintering, to produce a finished permanent magnet.

While pre-processing steps are being performed on the first belt conveyor 1, another metal die unit 7 is supplied from the second belt conveyor 2 onto the mounting base 12 of the permanent magnet molding apparatus and subjected to magnetizing and pressurizing operations.

Cleaning of the metal die unit 7 involves removal of the magnet molding material powder 3 adhering to the die 9, the lid member 10 and the punches 11 by use of a brush or a piece of cloth, for instance. It is possible to prevent scoring on the metal die unit 7 in a succeeding molding process by removing the magnet molding material powder 3.

Also, die lubricant is applied to the die 9, the lid member 10 and the punches 11 as necessary and excessively applied die lubricant is wiped off by a piece of cloth, for instance. It is possible to prevent scoring on the metal die unit 7 and reduce release resistance of the molded permanent magnet product 6 by applying the die lubricant.

According to this first embodiment, the metal die unit 7 is constructed of the base frame 8, the die 9, the lid member 10 and the pair of punches 11 so that the metal die unit 7 can be transferred as described above. After filling the magnet molding material powder 3 in the cavity 9*a* of the die 9 and closing the lid member 10 beforehand in the earlier manufacturing stage on the first belt conveyor 1, the metal die unit 7 is transferred by the second belt conveyor 2 and the first cylinder 15 to the position where the two pressurizing cylinders 17, 18 are located, and the molded permanent magnet product 6 is formed by pressing the magnet molding material powder 3 in the cavity 9*a* by moving the two punches 24 of the metal die unit 7 in their mutually approaching directions with the two pressurizing cylinders 17, 18 while applying the magnetic field to the magnet molding material powder 3 to magnetize it by the two coils 21, 22. Then, the metal die unit 7 is transferred from the fourth belt conveyor 5 onto the third belt conveyor 4 and, after the molded permanent magnet product 6 is removed from the cavity 9*a* on the third belt conveyor 4, the metal die unit 7 is returned back to the first belt conveyor 1 for successive recirculation. Since the magnetizing and pressurizing operations can be performed without interruption even when the magnet molding material powder 3 is being filled in this way, it is possible to achieve an improvement in productivity.

Furthermore, since the magnet molding material powder 3 is filled into the cavity 9a on the first belt conveyor 1 where the magnetic field is not generated, no variations occur in the amount of the magnet molding material powder 3 filled. This makes it possible to achieve an improvement in reliability.

Moreover, since the pair of pressurizing cylinders 17, 18 is used as the pressurizing means to perform the pressurizing operation with a simple structure, it is also possible to achieve a cost reduction.

Second Embodiment

Figure 7:
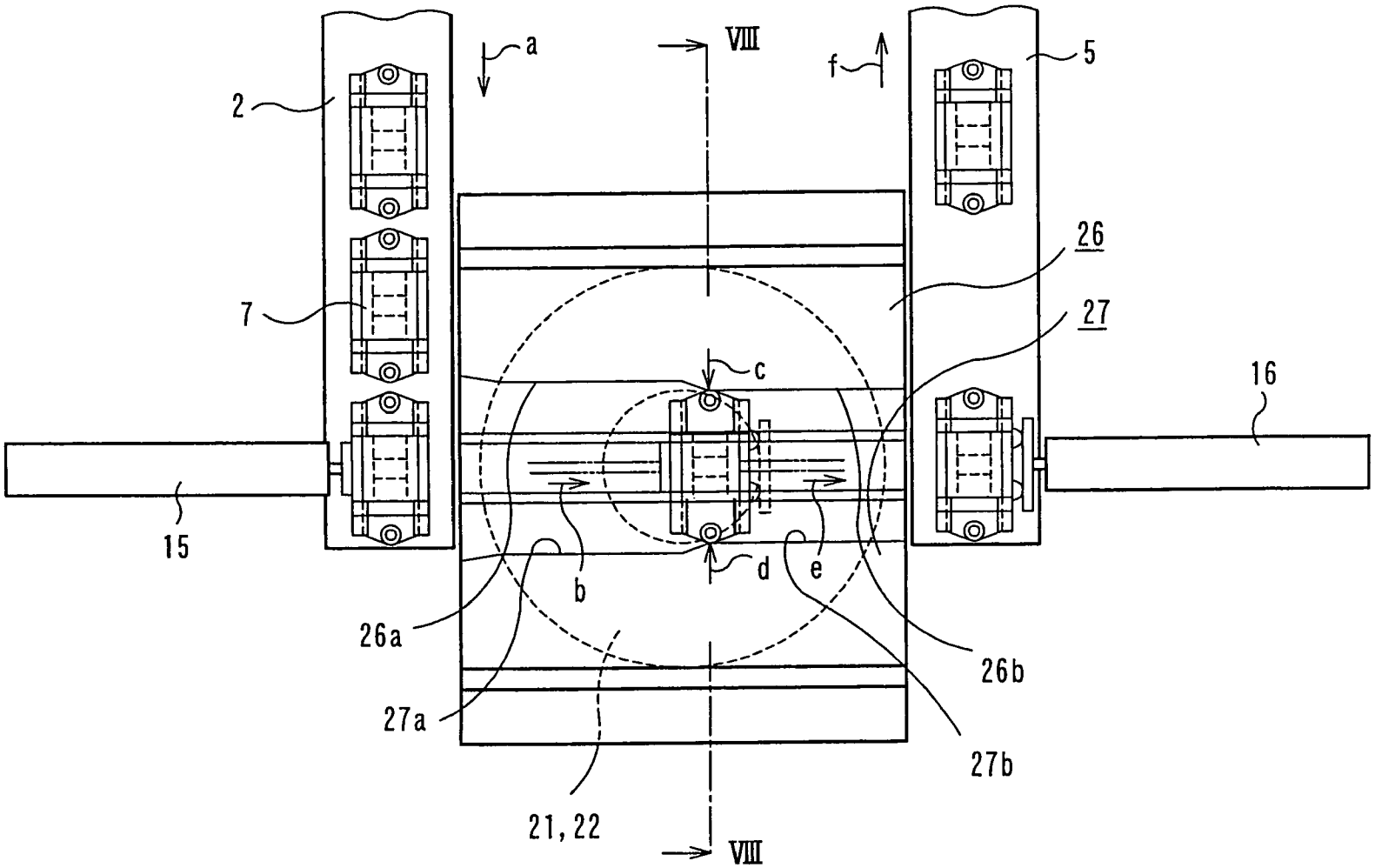
FIG. 7 is a plan view showing the construction of a permanent magnet molding apparatus according to a second embodiment of this invention.
Figure 8:
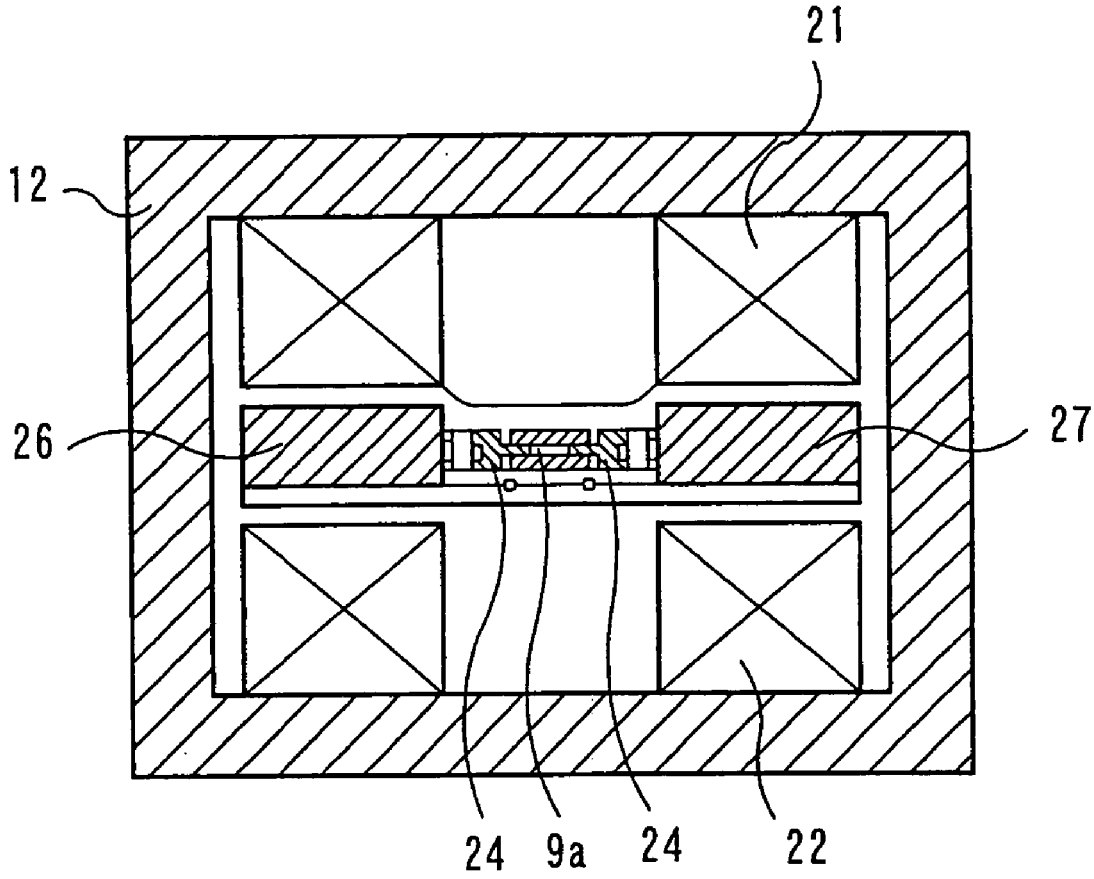
FIG. 8 is a sectional diagram showing a cross section taken along lines VIII-VIII of FIG. 7.
Figure 9:
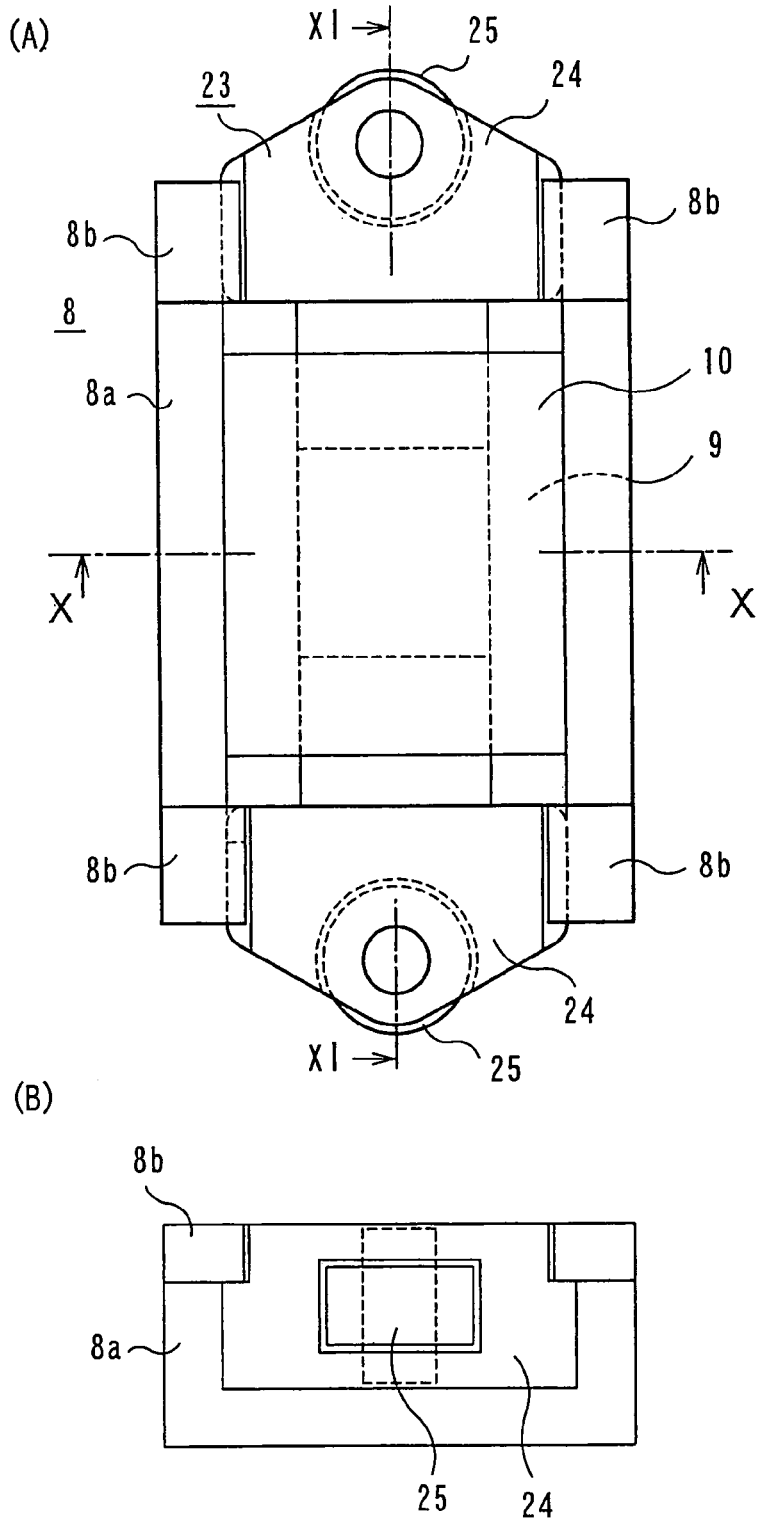
FIG. 9 shows the construction of a metal die unit shown in FIG. 7, in which (A) is a plan view and (B) is a front view.
Figure 10:
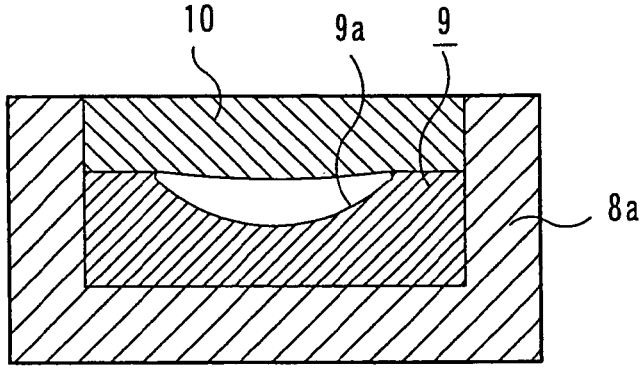
FIG. 10 is a sectional diagram showing a cross section taken along lines X-X of FIG. 9.
Figure 11:
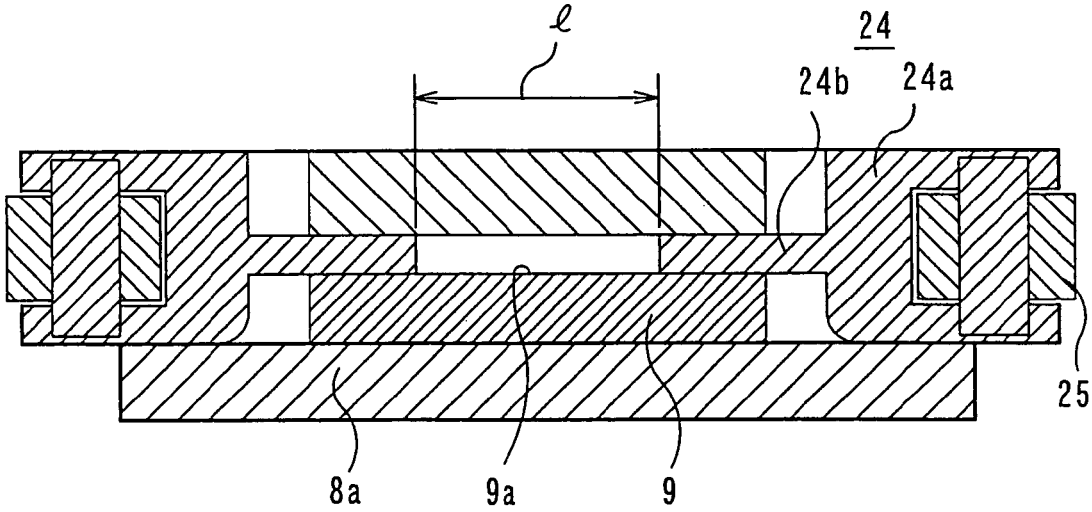
FIG. 11 is a sectional diagram showing a cross section taken along lines XI-XI of FIG. 9.

FIG. 7 is a plan view showing the construction of a permanent magnet molding apparatus according to a second embodiment of this invention, FIG. 8 is a sectional diagram showing a cross section taken along lines VIII-VIII of FIG. 7, FIG. 9 shows the construction of a metal die unit shown in FIG. 7, in which (A) is a plan view and (B) is a front view, FIG. 10 is a sectional diagram showing a cross section taken along lines X-X of FIG. 9, and FIG. 11 is a sectional diagram showing a cross section taken along lines XI-XI of FIG. 9.

In these Figures, portions similar to those of the aforementioned first embodiment are designated by the same reference numerals and their description is omitted here.

The apparatus of this embodiment is not provided with pressurizing cylinders like those of the aforementioned first embodiment but is provided with first guiding surfaces 26*a*, 27*a* and second guiding surfaces 26*b*, 27*b* formed on pressurizing platelike members 26, 27 as pressurizing means.

A guiding width continuously varies from the first guiding surfaces 26*a*, 27*a* such that the guiding width between the second guiding surfaces 26*b* and 27*b* formed on the pressurizing platelike members 26, 27 becomes narrower than the guiding width between the first guiding surfaces 26*a* and 27*a*. The pressurizing platelike members 26, 27 are positioned such that a narrow width portion between the second guiding surfaces 26*b* and 27*b* is located at a central position of a magnetic field formed by the two coils 21, 22.

As shown in FIGS. 9 to 11, a metal die unit 23 includes a base frame 8, a die 9, a lid member 10 and a pair of punches 24 each having a shaping part 24*b* of which one end has the same cross-sectional shape as a cavity 9*a* and slides and fits into the cavity 9*a* as if closing the cavity 9*a* at both ends as in the aforementioned first embodiment. Unlike the aforementioned first embodiment, however, each of the punches 24 has a pushing part 24*a* in which a roller 25 is located an opposite end. Sliding on the base frame 8 and between both members 8*a*, 8*b* of the base frame 8, the pushing parts 24*a* are so constructed as to be guided along the extending direction of the cavity 9*a*.

The two rollers 25 of the metal die unit 23 transferred on the second belt conveyor 2 are positioned opposite to each other. The two rollers 25 are constructed such that the distance between end surfaces of the shaping parts 24*b* is larger than the length of a molded permanent magnet product 6 shown by l (el) in FIG. 11 when opposite sides of both curved outer surfaces of the two rollers 25 are separated from each other by the same distance as the distance between the first guiding surfaces 26*a* and 27*a*. Also, the two rollers 25 are constructed such that the distance between the end surfaces of the shaping parts 24*b* becomes equal to the length of the molded permanent magnet product 6 shown by l (el) in FIG. 11 when the distance between the opposite sides of both curved outer surfaces of the two rollers 25 becomes equal to the distance between the first guiding surfaces 26*a* and 27*a*.

Operation of the permanent magnet molding apparatus of the second embodiment constructed as described above is now explained below referring to the drawings.

First, the metal die unit 23 of which cavity 9*a* has been filled with magnet molding material powder 3 in an earlier manufacturing stage is transferred from the first belt conveyor 1 to the second belt conveyor 2 as in the first embodiment. Then, as shown in FIG. 7, the metal die unit 23 moves on the second belt conveyor 2 in the extending direction of the cavity 9*a* along an arrow "a," and when the metal die unit 23 reaches a position corresponding to the first cylinder 15, the metal die unit 23 stops as it is forced against an unillustrated positioning jig. At this point, the first cylinder 15 begins to operate so that its piston extends and pushes out the halted metal die unit 23 in a direction shown by an arrow "b" intersecting the extending direction of the cavity 9*a* along the individual first guiding surfaces 26*a*, 27*a* of the two pressurizing platelike members 26, 27.

When the locations of the individual rollers 25 of the metal die unit 23 reach the individual second guiding surfaces 26*b*, 27*b* of the two pressurizing platelike members 26, 27, the two punches 24 are pushed in their mutually approaching directions via the rollers 25 since the distance between the second guiding surfaces 26*b* and 27*b* is made narrower than the distance between the first guiding surfaces 26*a* and 27*a*. Consequently, the individual shaping parts 24*b* move in the cavity 9*a* and their end surfaces are positioned face to face with each other at a specific distance. At this time, the magnet molding material powder 3 in the cavity 9*a* is in a state of being pressed at a specific force. Then, the two coils 21, 22 are activated in this state, so that the magnetic field is applied to the magnet molding material powder 3 in the direction perpendicular to the pressurizing direction and the magnet molding material powder 3 is magnetized.

When magnetization is finished, the two coils 21, 22 stops to operate. Subsequently, after performing a demagnetizing process by applying a reverse magnetic field, the second cylinder 16 begins to operate and its piston extends and reaches the location of the metal die unit 23. Then, although not discussed in detail here, after a sucking pad provided at a far end of the piston, for example, has sucked a side surface of the base frame 8 of the metal die unit 23, the piston contracts and returns to its original state as shown by an arrow "e" and sucking by the sucking pad is released, whereby the metal die unit 23 is transferred onto the fourth belt conveyor 5 and moves in the direction of an arrow "f" on the fourth belt conveyor 5. Then, in a manner similar to the first embodiment, the molded permanent magnet product 6 is removed from the cavity 9*a* in a later manufacturing stage performed on the third belt conveyor 4 and, although not illustrated, subjected to a post processing step, such as sintering to produce a finished permanent magnet.

After the molded permanent magnet product 6 is removed from the cavity 9*a*, the metal die unit 23 is cleaned and then returned back to the first belt conveyor 1 for successive recirculation. While pre-processing steps are being performed on the first belt conveyor 1, another metal die unit 23 is supplied from the-second belt conveyor 2 onto the mounting base 12 of the permanent magnet molding apparatus and subjected to magnetizing and pressurizing operations.

According to this second embodiment, the metal die unit 23 is constructed of the base frame 8, the die 9, the lid member 10 and the pair of punches 11 so that the metal die unit 23 can be transferred as described above. After filling the magnet molding material powder 3 in the cavity 9*a* of the die 9 and closing the lid member 10 beforehand in the earlier manufacturing stage on the first belt conveyor 1, the metal die unit 23 is transferred by the second belt conveyor 2 and the first cylinder 15 to a position between the two pressurizing platelike members 26, 27 and fed to the narrow width portion between the second guiding surfaces 26*b* and 27*b*. Consequently, the two punches 24 of the metal die unit 23 are caused to move in their mutually approaching directions, and the molded permanent magnet product 6 is formed by pressing the magnet molding material powder 3 in the cavity 9*a* while applying the magnetic field to the magnet molding material powder 3 to magnetize it by the two coils 21, 22. Then, the metal die unit 23 is transferred from the fourth belt conveyor 5 onto the third belt conveyor 4 and, after the molded permanent magnet product 6 is removed from the cavity 9*a* on the third belt conveyor 4, the metal die unit 7 (sic) is returned back to the first belt conveyor 1 for successive recirculation. Since the magnetizing and pressurizing operations can be performed without interruption even when the magnet molding material powder 3 is being filled in this way, it is possible to achieve an improvement in productivity.

Furthermore, since the magnet molding material powder 3 is filled into the cavity 9*a* on the first belt conveyor 1 where the magnetic field is not generated, no variations occur in the amount of the magnet molding material powder 3 filled. This makes it possible to achieve an improvement in reliability.

Moreover, the individual second guiding surfaces 26*b*, 27*b* of the two pressurizing platelike members 26, 27 are used as pressurizing means to guide the metal die unit 23 along the individual second guiding surfaces 26*b*, 27*b* and perform the pressurizing operation by moving the two punches 24. Since no source of motive power, such as a pressurizing cylinder, for directly forcing the punches 24 is required and maintenance is not necessary, it is possible to achieve a further cost reduction.

Although the metal die unit 7 is brought in and out in the same direction as shown by the arrows "b" and "e" in FIG. 1 and by the arrows "b" and "e" in FIG. 7 in the foregoing first and second embodiments, the metal die unit 7 may be brought in and out in opposite directions to return the metal die unit 7 to its original position.

Furthermore, although the apparatus is constructed such that the direction of pressurization by the pressurizing cylinders 17, 18 and the pressurizing platelike members 26, 27 serving as the pressurizing means intersects the directions in which the metal die unit 7 is brought in at right angles, the invention is not limited to this construction. It is possible to obtain the same advantageous effect even if the apparatus is constructed such that the pressurization direction matches the directions in which the metal die unit 7 is brought in.

Additionally, while the invention has been described with reference to a case where the magnetic field generating means is constructed of the pair of coils 21, 22, it is needless to say that the magnetic field generating means may be constructed of only one of the coils 21, 22 or a permanent magnet.

Third Embodiment

Figure 12:
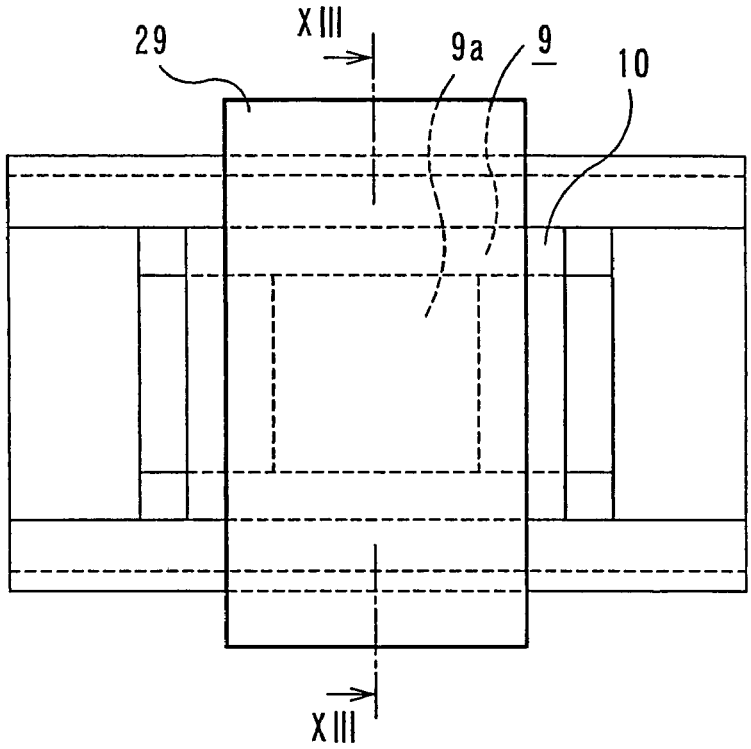
FIG. 12 is a plan view showing the construction of a metal die unit of a permanent magnet molding apparatus according to a third embodiment of this invention.
Figure 13:
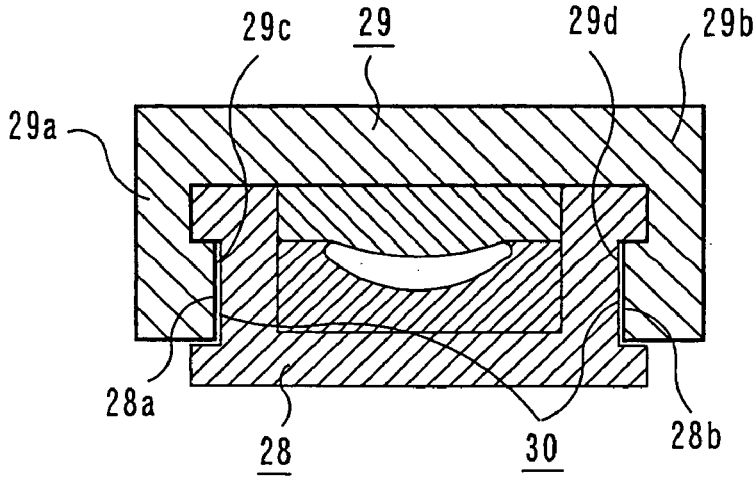
FIG. 13 is a sectional diagram showing a cross section taken along lines XIII-XIII of FIG. 12.
Figure 14:
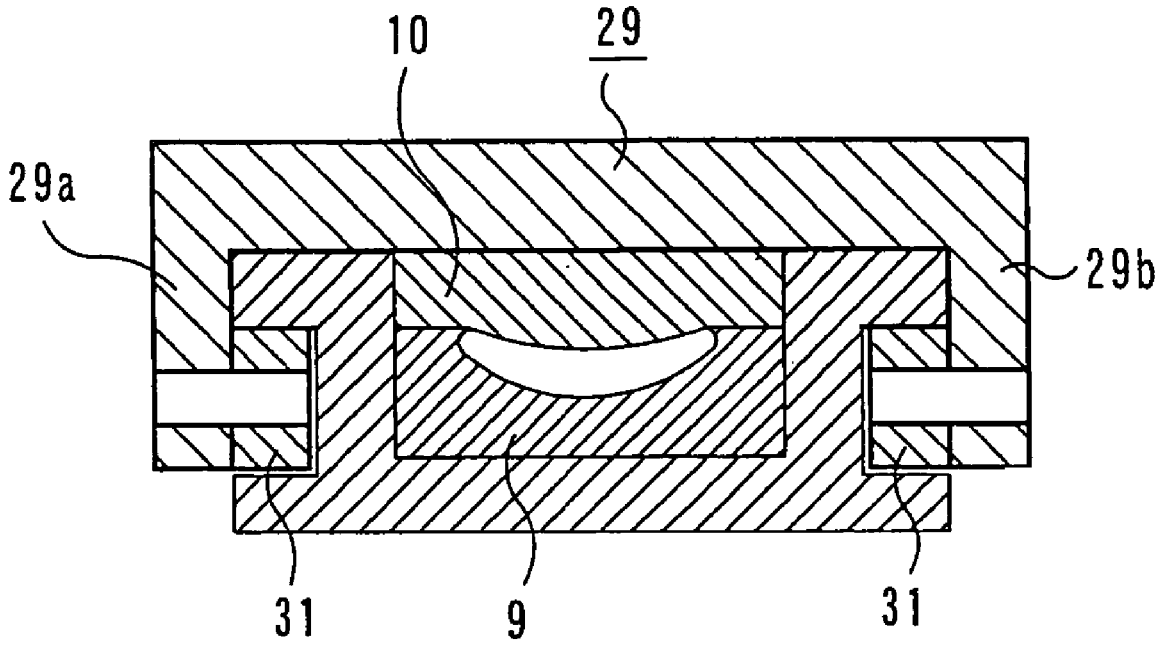
FIG. 14 is a sectional diagram showing a cross section taken along lines XIII-XIII of FIG. 12, particularly showing a construction different from the construction of FIG. 13.

FIG. 12 is a plan view showing the construction of a metal die unit of a permanent magnet molding apparatus according to a third embodiment of this invention, FIG. 13 is a sectional diagram showing a cross section taken along lines XIII-XIII of FIG. 12, and FIG. 14 is a sectional diagram showing a cross section taken along lines XIII-XIII of FIG. 12, particularly showing a construction different from the construction of FIG. 13.

In these Figures, portions similar to those of the aforementioned first embodiment are designated by the same reference numerals and their description is omitted here.

As shown in FIGS. 12 and 13, a base frame 28 is formed into a U-shaped cross section and a die 9 covered with a lid member 10 is placed at a central part of the base frame 28. There are formed locking grooves 28*a*, 28*b* in both side surfaces of the base frame 28. A grasping member 29 is situated on the base frame 28 to hold the lid member 10. The grasping member 29 has at its both ends bent portions 29*a*, 29*b* extending along both side surfaces of the base frame 28 and there are formed locking jaws 29*c*, 29*d* at extreme ends of the bent portions 29*a*, 29*b*. Constituting a locking mechanism 30 together with the locking grooves 28*a*, 28*b*, the locking jaws 29*c*, 29*d* mate with the two locking grooves 28*a*, 28*b*. The grasping member 29 made slidable on the base frame 28 in an extending direction of a cavity 9*a* with the aid of the locking mechanism 30.

According to this third embodiment, the lid member 10 is held by the grasping member 29 which can slide on the base frame 28 along the extending direction of the cavity 9*a* with the aid of the locking mechanism 30 as described above, so that the lid member 10 can be fitted and removed simply by moving the grasping member 29 along the extending direction of the cavity 9*a*. Therefore, it is possible to facilitate a step of filling magnet molding material powder 3 into the cavity 9*a* and a step of removing a molded permanent magnet product 6 out of the cavity 9*a* and thereby achieve an improvement in productivity.

While the locking mechanism 30 is constructed of the two locking grooves 28*a*, 28*b* in the base frame 28 and the two locking jaws 29*c*, 29*d* of the grasping member 29 in the construction of FIG. 13, there may be provided rollers 31 fitted on the extreme ends of the bent portions 29*a*, 29*b* instead of the locking jaws 29*c*, 29*d*. The provision of the rollers 31 serves to smoothen sliding motion of the grasping member 29 and further facilitate fitting and removal of the lid member 10.

Fourth Embodiment

Figure 15:
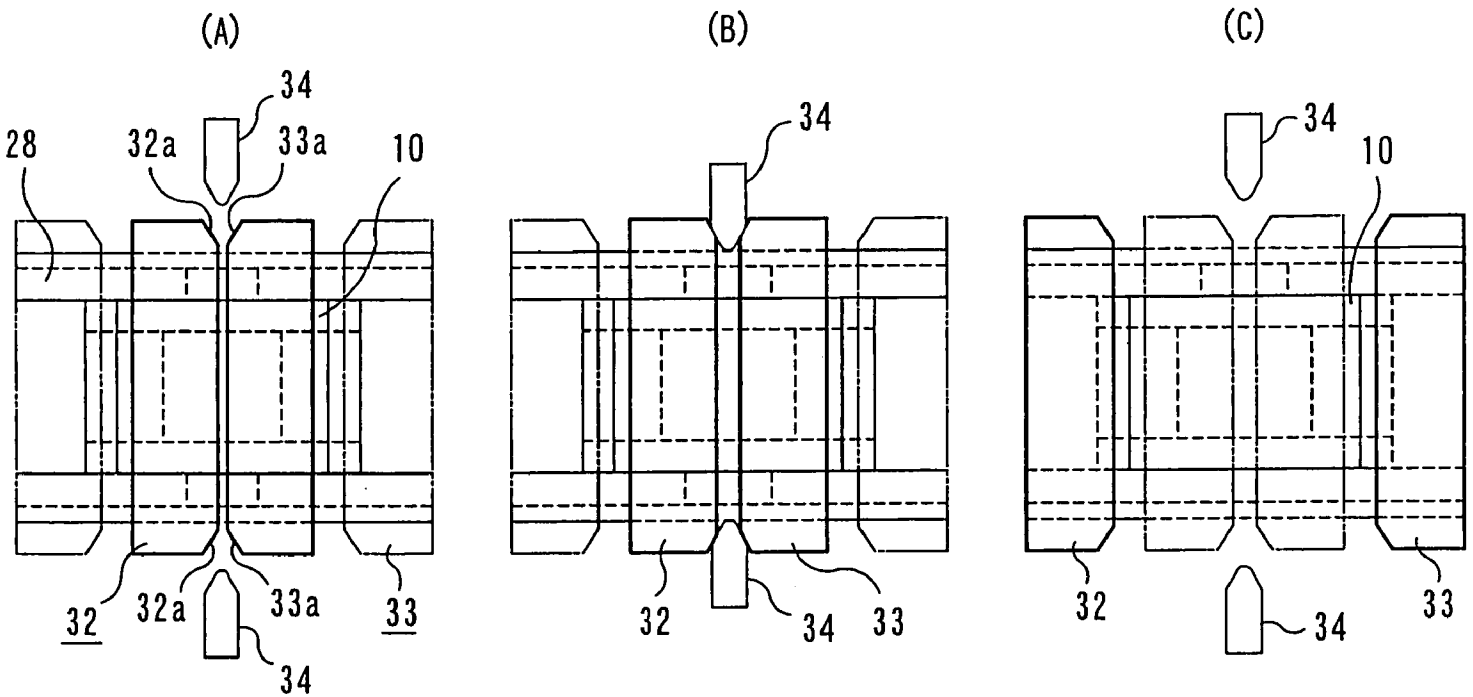
FIG. 15 is a diagram showing the operation of grasping members provided in a metal die unit of a permanent magnet molding apparatus according to a fourth embodiment of this invention.

FIG. 15 is a diagram showing the operation of grasping members of a metal die unit of a permanent magnet molding apparatus according to a fourth embodiment of this invention.

In this Figure, portions similar to those of the aforementioned third embodiment are designated by the same reference numerals and their description is omitted here.

As shown in FIG. 15(A), the grasping member 29 of the aforementioned third embodiment is divided into two portions along the extending direction of a cavity 9*a* to form a pair of grasping members 32, 33 in this embodiment. There are formed chamfered portions 32*a*, 33*a* on facing side surfaces of the individual grasping members 32, 33. The two grasping members 32, 33 are forced out as pushing members 34 are driven into a gap between the chamfered portions 32*a* and 33*a* as shown in FIG. 15(B), and the top of a lid member 10 is opened as shown in FIG. 15(C).

According to this fourth embodiment, the lid member 10 is held by the pair of half-split grasping members 32, 33 as described above, so that the lid member 10 can be fitted and removed simply by forcing out the two grasping members 32, 33 and moving them toward both sides of a base frame 28. It is therefore possible to achieve an improvement in productivity as in the third embodiment.

Fifth Embodiment

Figure 16:
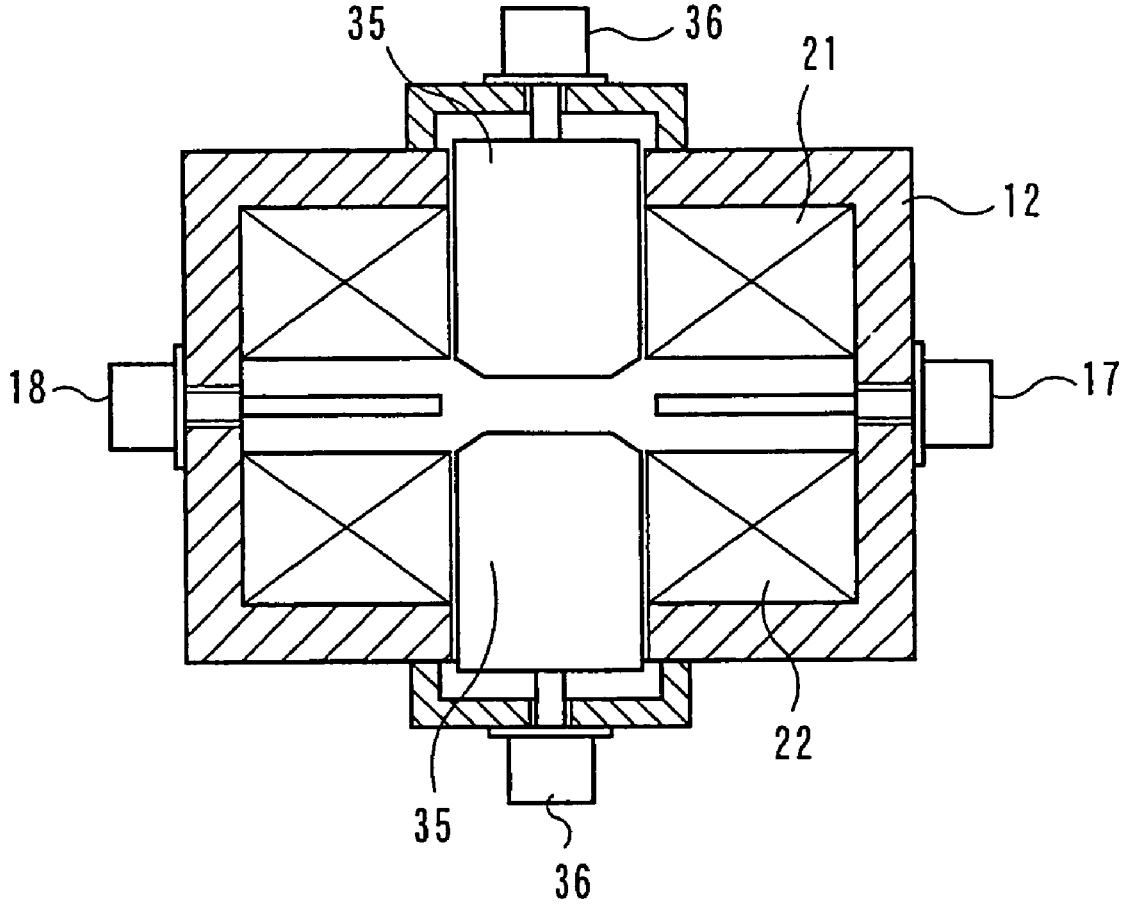
FIG. 16 is a sectional diagram showing the construction of a permanent magnet molding apparatus according to a fifth embodiment of this invention.
Figure 17:
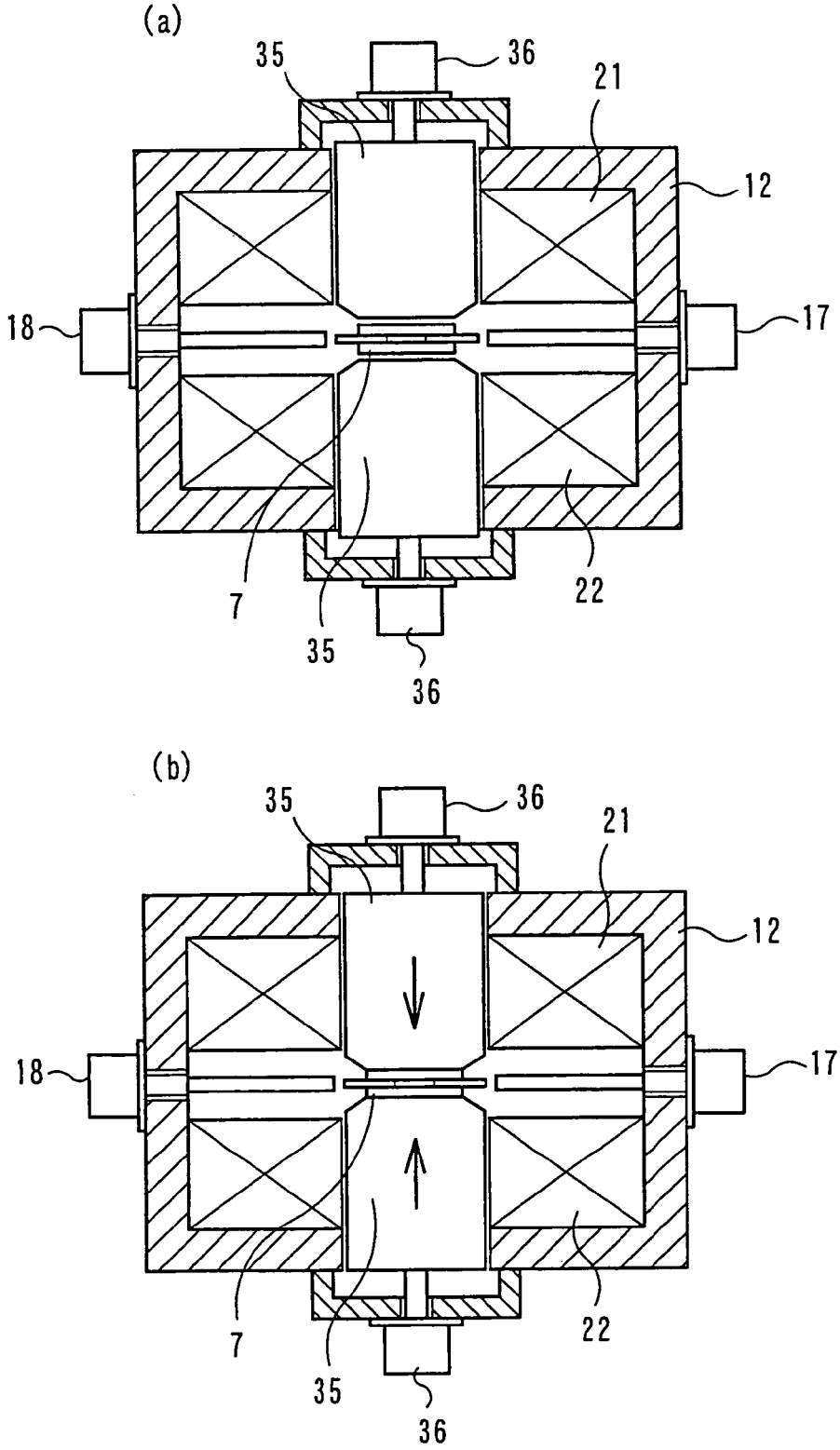
FIG. 17 is a sectional diagram illustrating the operation of the permanent magnet molding apparatus of the fifth embodiment of this invention.
Figure 18:
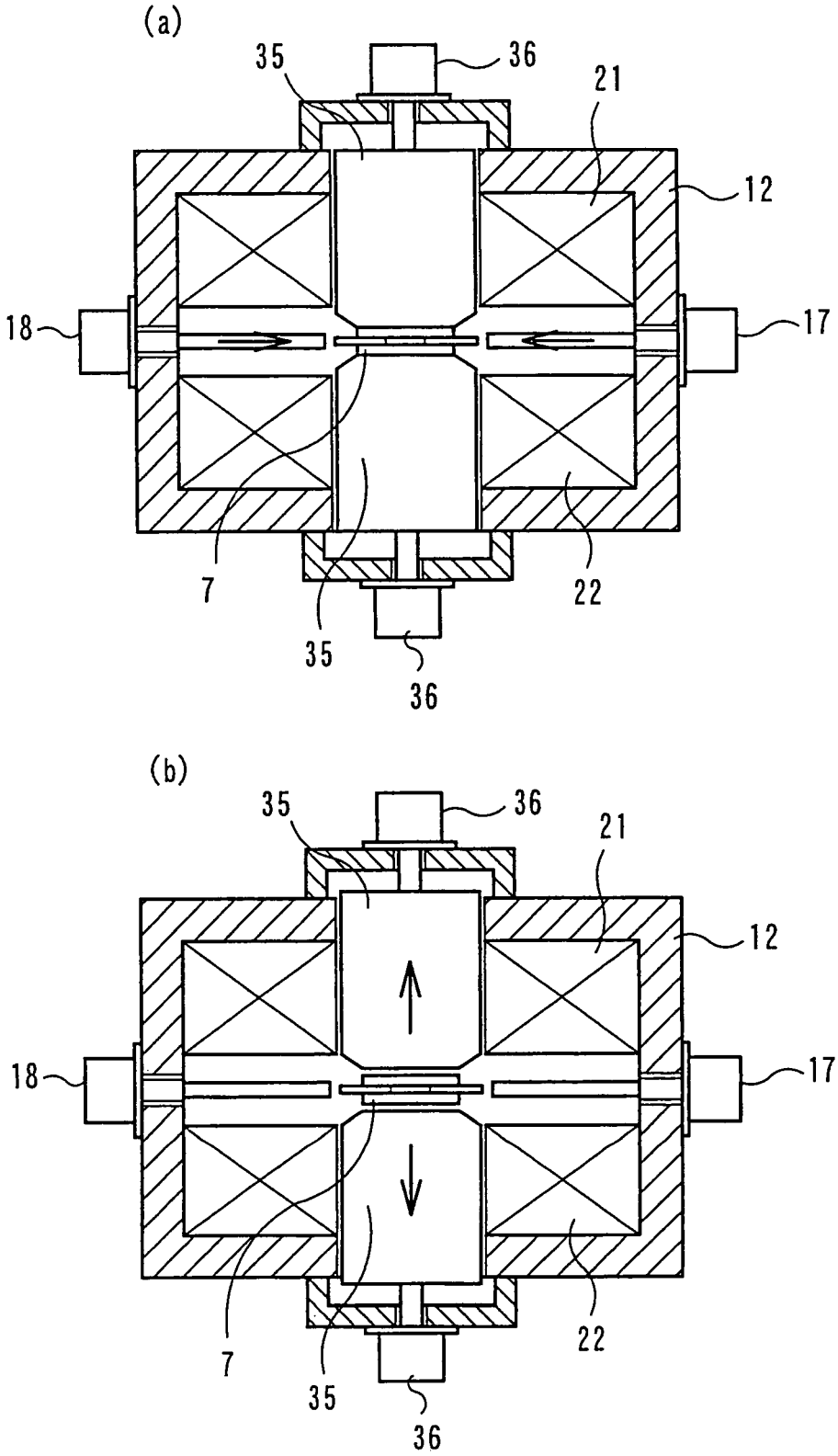
FIG. 18 is a sectional diagram illustrating the operation of the permanent magnet molding apparatus of the fifth embodiment of this invention.
Figure 19:
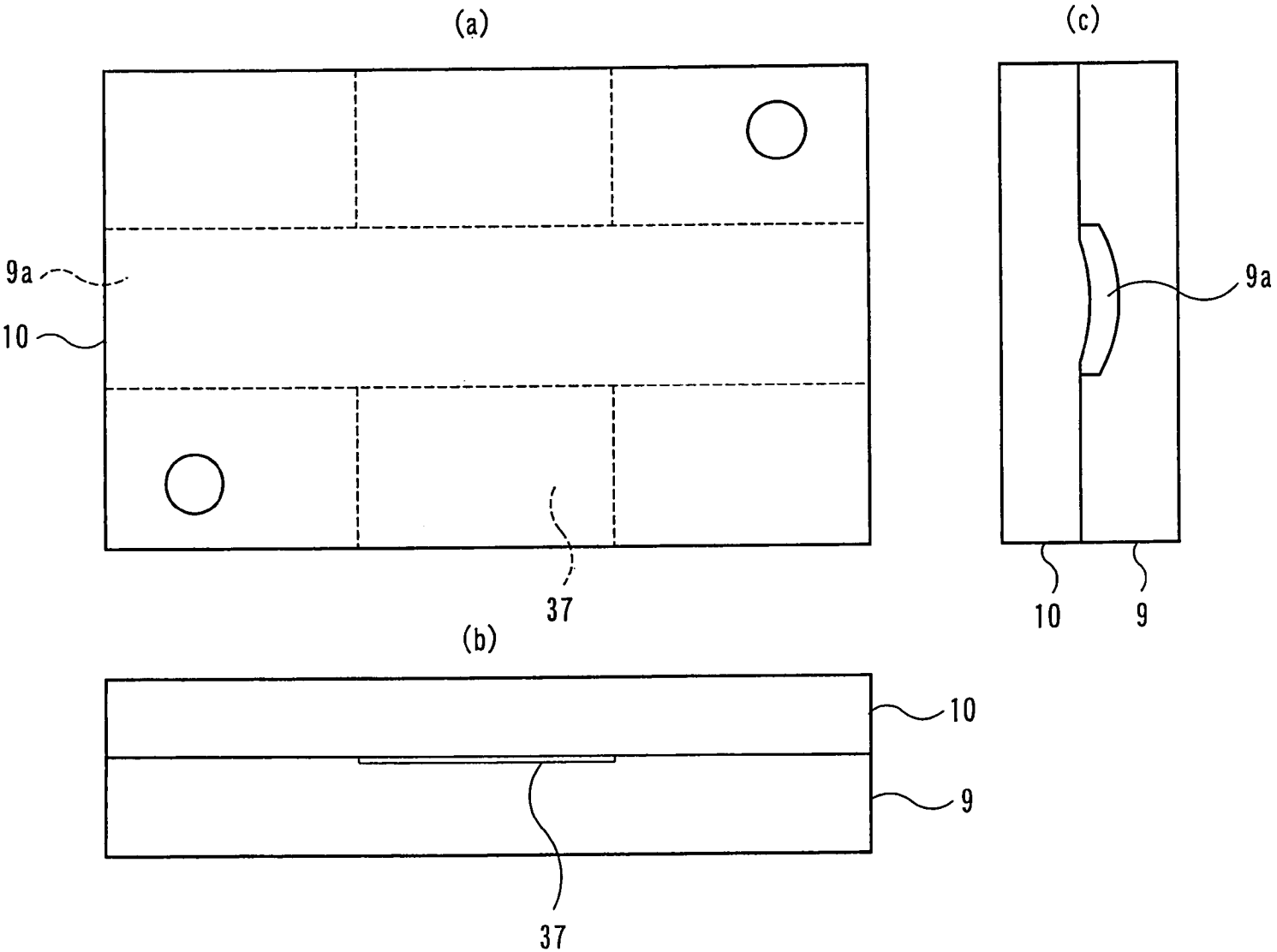
FIG. 19 is a (a) plan view, (b) front view and (c) side view showing a metal die unit of the permanent magnet molding apparatus of the fifth embodiment of this invention.

FIG. 16 is a sectional diagram showing a cross section of a principal part of a permanent magnet molding apparatus according to a fifth embodiment of this invention, FIGS. 17 and 18 are sectional diagrams illustrating the operation of the apparatus of FIG. 16, FIG. 19 is a (a) plan view, (b) front view and (c) side view showing a metal die unit of the permanent magnet molding apparatus.

In these Figures, portions similar to those of the aforementioned first embodiment are designated by the same reference numerals and their description is omitted here.

In this fifth embodiment, there are provided yokes 35 made of a ferromagnetic material on which coils 21, 22 are wound and the individual yokes 35 are made movable up and down by air cylinders 36 fixed to a mounting base 12 as shown in FIG. 16.

Operation of the permanent magnet molding apparatus constructed as described above is now explained below referring to the drawings.

As in the aforementioned first embodiment, a metal die unit 7 of which cavity has been filled with magnet molding material powder 3 in an earlier manufacturing stage is transferred by individual belt conveyors and fed in such a manner that a central position of the metal die unit 7 is located at a central position of the yokes 35 as shown in FIG. 17(*a*).

The metal die unit 7 used in this fifth embodiment does not require any grasping member for pressing a lid member against a die unlike the aforementioned third or third embodiment.

Next, the metal die unit 7 is sandwiched by the individual yokes 35 by actuating the individual air cylinders 36 and a magnetizing field is generated by the coils 21, 22 as shown in FIG. 17(*b*).

When this magnetizing field occur, there occurs an attractive force between the individual yokes 35, whereby facing surfaces of the die and the lid member of the metal die unit 7 are forced against each other and the magnet molding material powder in the metal die unit 7 is magnetized by the magnetizing field.

The air cylinders 36 may be of a type having a capability to lift the individual yokes 35 and there is no need for such equipment that can produce a large force like hydraulic cylinders.

Next, under conditions where the magnetizing field is being generated, the magnet molding material powder in the metal die unit 7 is compressed to form a molded product by actuating pressurizing cylinders 17, 18 in arrow directions and pushing punches 11 as shown in FIG. 17(*a*).

In the metal die unit 7, there is formed a gap 37 of about 0.01 mm to 0.1 mm between the die 9 and the lid member 10 in part of their facing surfaces as shown in FIG. 19. Gas, such as air or inert gas, remaining in empty spaces in the metal die unit 7 or the magnet molding material powder is smoothly discharged through the gap 37. If gas remains in the empty spaces in the metal die unit 7 or the magnet molding material powder, cracks may occur in a molded permanent magnet product since the gas once compressed expands, for instance, when pressurization by the punches 11 is released. With the provision of the gap 37, however, the gas in the metal die unit 7 is smoothly discharged, so that a molded permanent magnet product free of defects like cracks is obtained.

Next, the pressurizing cylinders 17, 18 are actuated in reverse directions shown by arrows as shown in FIG. 17(*b*) to release pressure exerted on the punches 11. Although pressurizing force (residual stress) applied to the molded permanent magnet product is released a little at this time, the metal die unit 7 remains to be pressed by the yokes 35. Therefore, the residual stress in the molded permanent magnet product remains almost unchanged due to friction between wall surfaces of a cavity 9*a* of the metal die unit 7 and the molded product.

Subsequently, the magnetizing field produced by the coils 21, 22 is cut off and the yokes 35 are moved upward and downward as shown by arrows by the air cylinders 36. Since the pressurizing force applied to the lid member 10 and the die 9 of the metal die unit 7 is removed and the residual stress in the molded permanent magnet product is uniformly released simultaneously at this time, cracks and external defects would not easily occur.

Then, in a manner similar to the first embodiment, the molded permanent magnet product is removed from the cavity in a later manufacturing stage performed on the third belt conveyor and, although not illustrated, subjected to a post processing step, such as sintering to produce a finished permanent magnet.

According to this fifth embodiment, the yokes 35 are held in close contact with the metal die unit 7 as seen above, so that a large and uniform magnetizing field is produced.

Also, the metal die unit 7 is supplied to a position between the yokes 35 and the metal die unit 7 is pressed by producing the attractive force between the yokes 35 by the magnetizing field of the coils 21, 22, it is possible to eliminate the need for large-sized equipment like hydraulic cylinders for pressing the lid member of the metal die unit 7 against the die or a complicated structure for pressurizing the metal die unit 7.

In addition, because the residual stress in the molded permanent magnet product in the metal die unit 7 is uniformly released at the same time when the magnetizing field is cut off and the pressurizing force applied to the metal die unit 7 is removed, cracks and external defects are unlikely to occur.

While the foregoing discussion of the fifth embodiment has illustrated a case where the coils 21, 22 are wound around the pair of yokes 35, a single coil may be wound around one of the pair of yokes 35.

Also, while the foregoing discussion has illustrated an example in which the pressurizing cylinders are used as a source of motive power, motors may be used as instead of the pressurizing cylinders.

INDUSTRIAL APPLICABILITY

This invention is intended for use in the manufacture of permanent magnets used in rotating electric machines such as motors.

The invention claimed is:

1. A permanent magnet molding apparatus comprising:

a mounting base;

a plurality of transferable metal die units that are transferable onto and off said mounting base, each metal die unit including:

a die having a cavity of a desired cross-sectional shape in which magnet molding material powder is prefillable before being transferred to the mounting base, the cavity extending in groovelike form in a specific direction on a surface of the die;

a lid member placed against a facing surface of said die as if covering said cavity; and a pair of punches having the same cross-sectional shape as said cavity, said punches being positioned to fit in said cavity such that said punches close said cavity at both ends thereof, and said punches being made slidable in directions in which said punches go into contact with and become separated from the magnet molding material powder;

means for transferring the plurality of metal die units one by one onto and off said mounting base;

pressurizing means for holding the plurality of metal die units one by one, which have been transferred to said mounting base, with said magnet molding material powder prefilled in said cavity and for pressurizing said magnet molding material powder by driving said two punches such that said two punches slide in their approaching directions; and magnetic field generating means for magnetizing the magnet molding material powder pressurized in said cavity while applying a magnetic field thereto in a direction perpendicular to a direction of pressurization.

2. The permanent magnet molding apparatus as recited in claim 1, said permanent magnet molding apparatus being characterized in that said magnetic field generating means includes a pair of yokes located on an upper surface of the lid member and on a bottom surface of the die of said metal die unit and a coil wound around at least one of said yokes, wherein said yokes are movable in directions along said facing surface of the lid member and the die of said metal die unit.

3. The permanent magnet molding apparatus as recited in claim 2, said permanent magnet molding apparatus being characterized in that said pair of yokes are attracted by each other and sandwich said lid member and said die to press against said facing surface when said coil is actuated.

4. The permanent magnet molding apparatus as recited in claim 1, said permanent magnet molding apparatus being characterized in that said metal die unit has a gap of 0.01 to 0.1 mm in part of said facing surface.

5. The permanent magnet molding apparatus as recited in claim 1, said permanent magnet molding apparatus being characterized in that said metal die unit has a base frame on which said die is located and said pair of punches has pushing parts at one end which are pressed by said pressurizing means and caused to slide on said base frame while being guided along the extending direction of said cavity.

6. The permanent magnet molding apparatus as recited in claim 5, said permanent magnet molding apparatus being characterized in that said pressurizing means is a pair of cylinders situated along the extending direction of said cavity, wherein pistons of said cylinders extend face to face with end surfaces of the pushing parts of said punches to push said pushing parts, causing said punches to slide in their mutually approaching directions.

7. The permanent magnet molding apparatus as recited in claim 5, said permanent magnet molding apparatus being characterized by further comprising a grasping member which engages with said base frame, wherein said grasping member fits slidably in the extending direction of said cavity and said lid member is forced against said die and held in position via a locking mechanism between said base frame and said grasping member.

8. The permanent magnet molding apparatus as recited in claim 7, said permanent magnet molding apparatus being characterized in that said grasping member is divided into two portions in its sliding direction.

9. The permanent magnet molding apparatus as recited in claim 1, said permanent magnet molding apparatus being characterized in that said metal die unit has a base frame on which said die is located and said pair of punches has pushing parts at one end which are pushed by said pressurizing means and caused to slide on said base frame while being guided along the extending direction of said cavity, said pushing parts having rotatably mounted rollers.

10. The permanent magnet molding apparatus as recited in claim 9, said permanent magnet molding apparatus being characterized in that said pressurizing means has first guiding surfaces for guiding said rollers and second guiding surfaces formed immediately adjacent to the respective first guiding surfaces, wherein the distance between said second guiding surfaces is smaller than the distance between said first guiding surfaces and said second guiding surfaces press against said rollers, causing said punches to slide in their mutually approaching directions.

11. The permanent magnet molding apparatus as recited in claim 9, said permanent magnet molding apparatus being characterized by further comprising a grasping member which engages with said base frame, wherein said grasping member fits slidably in the extending direction of said cavity and said lid member is forced against said die and held in position via a locking mechanism between said base frame and said grasping member.

12. The permanent magnet molding apparatus as recited in claim 11, said permanent magnet molding apparatus being characterized in that said grasping member is divided into two portions in its sliding direction.

13. A permanent magnet molding apparatus comprising:

a mounting base;

a transferable metal die unit transferable onto and off said mounting base, the metal die unit including:

a die having a cavity of a desired cross-sectional shape for containing magnet molding material powder, the cavity extending in groovelike form in a specific direction on a surface of the die;

a lid member placed against a facing surface of said die as if covering said cavity;

a base frame on which the die is located; and a pair of punches having the same cross-sectional shape as said cavity, said punches being positioned to fit in said cavity such that said punches close said cavity at both ends thereof, and said punches being slidable on said base frame while being guided along the extending direction of said cavity to cause said punches go into contact with and become separated from magnet molding material powder in said cavity;

pressurizing means for holding the metal die unit, which has been transferred to said mounting base, with said magnet molding material powder in said cavity and for pressurizing said magnet molding material powder by driving said two punches such that said two punches slide in their approaching directions;

a grasping member which engages with said base frame, wherein said grasping member fits slidably in the extending direction of said cavity and said lid member is forced against said die and held in position via a locking mechanism between said base frame and said grasping member; and magnetic field generating means for magnetizing the magnet molding material powder pressurized in said cavity while applying a magnetic field thereto in a direction perpendicular to a direction of pressurization.

14. The permanent magnet molding apparatus as recited in claim 13, said permanent magnet molding apparatus being characterized in that said grasping member is divided into two portions in its sliding direction.

* * * * *